US008354977B2

(12) United States Patent
Chen et al.

(10) Patent No.: US 8,354,977 B2
(45) Date of Patent: Jan. 15, 2013

(54) DRIVING METHOD FOR SOLVING PROBLEM OF CROSS TALK EFFECT OF DISPLAY PANEL

(75) Inventors: Chien-Hua Chen, Hsinchu (TW); Hui-Lung Yu, Hsinchu (TW); Yu-Hui Chou, Hsinchu (TW); Chang-Hung Yang, Hsinchu (TW); Hsueh-Ying Huang, Hsinchu (TW); Min-Feng Chiang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 850 days.

(21) Appl. No.: 12/166,320

(22) Filed: Jul. 1, 2008

(65) Prior Publication Data

US 2009/0213043 A1 Aug. 27, 2009

(30) Foreign Application Priority Data

Feb. 27, 2008 (TW) ..... 97106920 A

(51) Int. Cl.
*G09G 3/20* (2006.01)

(52) U.S. Cl. ..... 345/58; 345/96; 345/210

(58) Field of Classification Search ..... 345/58, 345/97, 96, 209, 210
See application file for complete search history.

(56) References Cited

U.S. PATENT DOCUMENTS 5,159,326 A * 10/1992 Yamazaki et al. ..... 345/101
5,182,549 A * 1/1993 Taniguchi et al. ..... 345/97
5,673,062 A * 9/1997 Katakura et al. ..... 345/95
6,061,045 A * 5/2000 Inaba ..... 345/95
6,195,137 B1 * 2/2001 Inaba et al. ..... 349/37
6,531,997 B1 * 3/2003 Gates et al. ..... 345/107
6,906,692 B2 6/2005 Ishiyama
7,084,845 B2 8/2006 Hong
7,148,885 B2 12/2006 Nose
7,268,764 B2 9/2007 Song et al.
2004/0207592 A1 * 10/2004 Ludden ..... 345/96
2008/0001890 A1 1/2008 Song et al.
2008/0100602 A1 * 5/2008 Arai et al. ..... 345/205

FOREIGN PATENT DOCUMENTS

CN 1983373 6/2007
CN 101025498 A 8/2007

OTHER PUBLICATIONS

"Office Action of China Counterpart Application", issued on Apr. 8, 2011, p. 1-p. 4, in which the listed reference was cited.
"3rd Office Action of China Counterpart Application", issued on Aug. 25, 2010, p. 1-p. 5, in which the listed reference was cited.
"Office Action of Taiwan Counterpart Application", issued on Sep. 19, 2012, p. 1-p. 9, in which the listed references were cited.

* cited by examiner

*Primary Examiner* — Chanh Nguyen
*Assistant Examiner* — Robert Stone
(74) *Attorney, Agent, or Firm* — Jianq Chyun IP Office

(57) ABSTRACT

A method for driving a display panel includes generating data signals to drive pixels in the display panel. The pixels in the display panel are arranged in a matrix. In addition, the voltage values of the data signals are adjusted to render a sum of voltage values of the data signals in a unit area as zero.

2 Claims, 13 Drawing Sheets

1102 F1

| | | | | | |
|---|---|---|---|---|---|
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |
| -1 | +2 | -1 | +1 | -2 | +1 |
| +2 | -1 | +1 | -2 | +1 | -1 |

1102 F2

| | | | | | |
|---|---|---|---|---|---|
| +1 | -2 | +1 | -1 | +2 | -1 |
| -2 | +1 | -1 | +2 | -1 | +1 |
| +1 | -1 | +2 | +1 | +1 | -2 |
| -1 | +2 | -1 | +1 | -2 | +1 |
| +2 | -1 | +1 | -2 | +1 | -1 |
| -1 | +1 | -2 | +1 | -1 | +2 |

1102 F3

| | | | | | |
|---|---|---|---|---|---|
| -2 | +1 | -1 | +2 | -1 | +1 |
| +1 | -1 | +2 | -1 | +1 | -2 |
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |

1102 F4

| | | | | | |
|---|---|---|---|---|---|
| +1 | -1 | +2 | -1 | +1 | -2 |
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |

1102 F5

| | | | | | |
|---|---|---|---|---|---|
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |

1102 F6

| | | | | | |
|---|---|---|---|---|---|
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |
| -1 | +2 | -1 | +1 | -2 | 1 |

| | | | | | | | |
|---|---|---|---|---|---|---|---|
| γ1(+) | γ2(−) | γ1(+) | γ2(−) | γ1(+) | γ2(−) | γ1(+) | γ2(−) |
| γ2(−) | γ1(+) | γ2(−) | γ1(+) | γ2(−) | γ1(+) | γ2(−) | γ1(+) |
| γ1(+) | γ2(−) | γ1(+) | γ2(−) | γ1(+) | γ2(−) | γ1(+) | γ2(−) |
| γ2(−) | γ1(+) | γ2(−) | γ1(+) | γ2(−) | γ1(+) | γ2(−) | γ1(+) |

1102

F1

| | | | | | |
|---|---|---|---|---|---|
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |
| -1 | +2 | -1 | +1 | -2 | +1 |
| +2 | -1 | +1 | -2 | +1 | -1 |

1102

F2

| | | | | | |
|---|---|---|---|---|---|
| +1 | -2 | +1 | -1 | +2 | -1 |
| -2 | +1 | -1 | +2 | -1 | +1 |
| +1 | -1 | +2 | +1 | +1 | -2 |
| -1 | +2 | -1 | +1 | -2 | +1 |
| +2 | -1 | +1 | -2 | +1 | -1 |
| -1 | +1 | -2 | +1 | -1 | +2 |

1102

F3

| | | | | | |
|---|---|---|---|---|---|
| -2 | +1 | -1 | +2 | -1 | +1 |
| +1 | -1 | +2 | -1 | +1 | -2 |
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |

1102

F4

| | | | | | |
|---|---|---|---|---|---|
| +1 | -1 | +2 | -1 | +1 | -2 |
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |

1102

F5

| | | | | | |
|---|---|---|---|---|---|
| -1 | +2 | -1 | +1 | -2 | +1 |
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |

1102

F6

| | | | | | |
|---|---|---|---|---|---|
| +2 | -1 | +1 | -2 | +1 | -1 |
| -1 | +1 | -2 | +1 | -1 | +2 |
| +1 | -2 | +1 | -1 | +2 | -1 |
| -2 | +1 | -1 | +2 | -1 | +1 |
| +1 | -1 | +2 | -1 | +1 | -2 |
| -1 | +2 | -1 | +1 | -2 | 1 |

FIG. 11

DRIVING METHOD FOR SOLVING PROBLEM OF CROSS TALK EFFECT OF DISPLAY PANEL

CROSS-REFERENCE TO RELATED APPLICATION

This application claims the priority benefit of Taiwan application serial no. 97106920, filed Feb. 27, 2008. The entirety of the above-mentioned patent application is hereby incorporated by reference herein and made a part of this specification.

BACKGROUND OF THE INVENTION

1. Field of the Invention

The present invention is related to a method for driving a display panel, and particularly to a driving method for solving the problem of the cross talk effect of a display panel.

2. Description of Related Art

FIG. 1 is a structure diagram of a conventional liquid crystal display (LCD) panel. Referring to FIG. 1, a conventional display panel 100 includes a lower substrate 102 and an upper substrate 104. On a surface of the lower substrate 102 facing the upper substrate 104, a plurality of data lines such as D1, D2, D3 and D4 and a plurality of scan lines such as S1 and S2 are disposed and interlaced with each other. Furthermore, on a surface of the upper substrate 104 facing the lower substrate 102, a plurality of color filters 110 is disposed. A common electrode 112 is formed on the color filter 110. In addition, a liquid crystal material is filled between the lower substrate 102 and the upper substrate 104. Therefore, a capacitor exists between the data lines D1-D4 and the common electrode 112.

FIG. 2A is a waveform diagram of data signals and a common voltage of a conventional LCD panel. Referring to both FIGS. 1 and 2A, data signals DS1, DS2, DS3, and DS4 may be transmitted to the data lines D1, D2, D3 and D4 in the display panel 100 respectively. In FIG. 2A, r1 is defined as a bright state voltage, and r2 is defined as a dark state voltage. When one of the scan lines is enabled, the data signals DS1, DS2, DS3 and DS4 may drive each pixel enabled by the scan line.

In some conventional technology, a technique of partitioning time is provided, i.e. partitioning a frame time into at least two sub-frame times. Each of the sub-frame times displays one sub-grayscale. Thus, an image displayed by the display panel within one frame time is constituted by at least two sub-grayscales. Regarding this time-partitioning technique, the conventional technology provides a method of double data rate (DDR) for driving the display panel, as illustrated in FIG. 2B. Referring to FIG. 2B, in this conventional driving technique, a different voltage may be applied to each pixel in different images according to different γ voltage set values to solve the problem of color washout.

Since the liquid crystal capacitance exists in each pixel and in the conventional art the voltage and the polarity transmitted to one pixel are different from those transmitted to another pixel, the coupling effect between adjacent pixels would occur and common voltages Vcom in different areas on the display panel 100 may thus vary. Therefore, most conventional technologies for driving the LCD panel (including DDR driving technique) would cause uneven luminance on the display panel, as illustrated in FIG. 2C. In FIG. 2C, different display areas A1, A2, and A3 have different luminance, which is called the cross talk effect.

SUMMARY OF THE INVENTION

Accordingly, the present invention provides a method for driving a display panel and the method can mitigate the problems of cross talk and color washout.

In addition, the present invention provides a solution to the cross talk effect. The solution does not require altering a hardware design to effectively reduce influence of the cross talk effect on the display panel.

The present invention provides a method for driving a display panel. The driving method includes generating a plurality of data signals to drive a plurality of pixels in the display panel. The pixels in the display panel are arranged in a matrix. Moreover, voltage polarities and voltage levels of the data signals are adjusted so as to render the voltage values of the data signals in a unit area of the display panel as substantially zero.

From another viewpoint, the present invention also provides a solution to the cross talk effect suitable for a display panel having a pixel array. The solution of the present invention includes adjusting a cross voltage level of a liquid crystal capacitor in each pixel to be the same as a cross voltage level of another pixel in a corresponding position within a unit area of the pixel array. Additionally, in the unit area, the cross voltage polarity of the liquid crystal capacitor in each pixel is adjusted as opposite to the cross voltage polarity of the liquid crystal capacitor in another pixel in a corresponding position within the unit area.

In the present invention, a sum of voltage values of data signals in a unit area is rendered zero so that the present invention effectively mitigates the cross talk effect and further solves the problem of color washout. Further, in the present invention, since the cross voltage of the liquid crystal capacitor is adjusted to solve the problem of the cross talk effect, only a method for controlling a firmware but not a hardware structure, is required to be altered so that the present invention achieves its desired effects with less costs.

In order to make the aforementioned and other objects, features and advantages of the present invention more comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 11 is a schematic view illustrating voltage values of pixels on a display panel in different frames according to the fifth embodiment of the present invention.

DESCRIPTION OF EMBODIMENTS

The present invention provides a plurality of means for driving a display panel in subsequent paragraphs. The primary spirit of the present invention lies in partitioning a pixel array of a display panel into a plurality of unit areas and adjusting voltage polarities and voltage levels of pixels in each of the unit areas so that a sum of data voltage values in each of the unit areas is zero. Thus, the influence of the cross talk effect on the display panel is effectively restrained. Please refer to the subsequent paragraphs for a detailed description of the foregoing.

The First Embodiment

Figure 1:
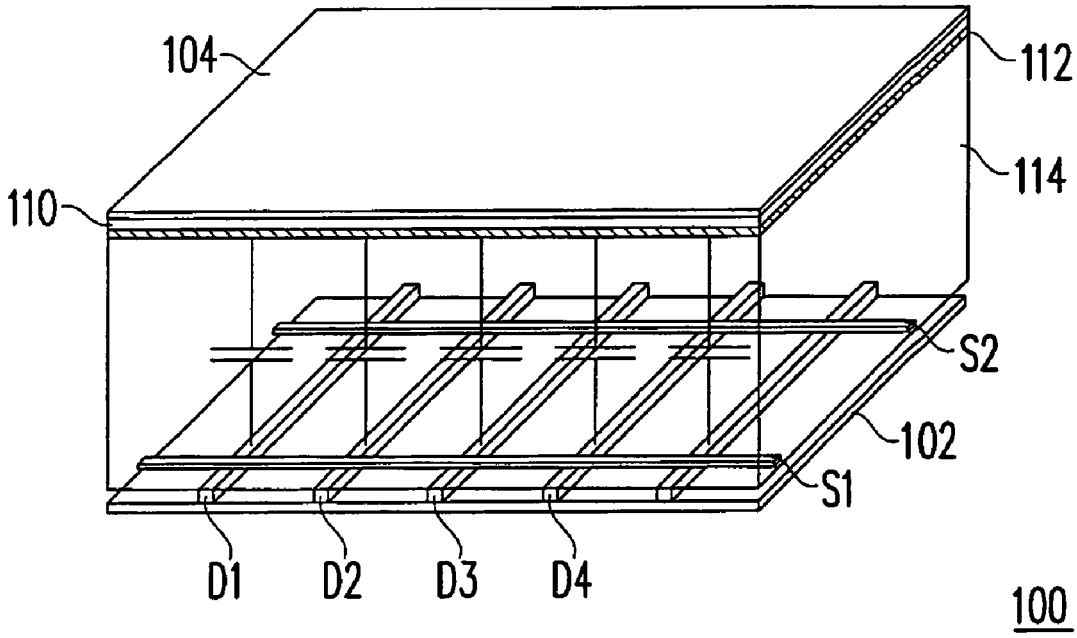
FIG. 1 (PRIOR ART)
FIG. 1 illustrates a structure diagram of a conventional LCD panel.
Figure 2A:
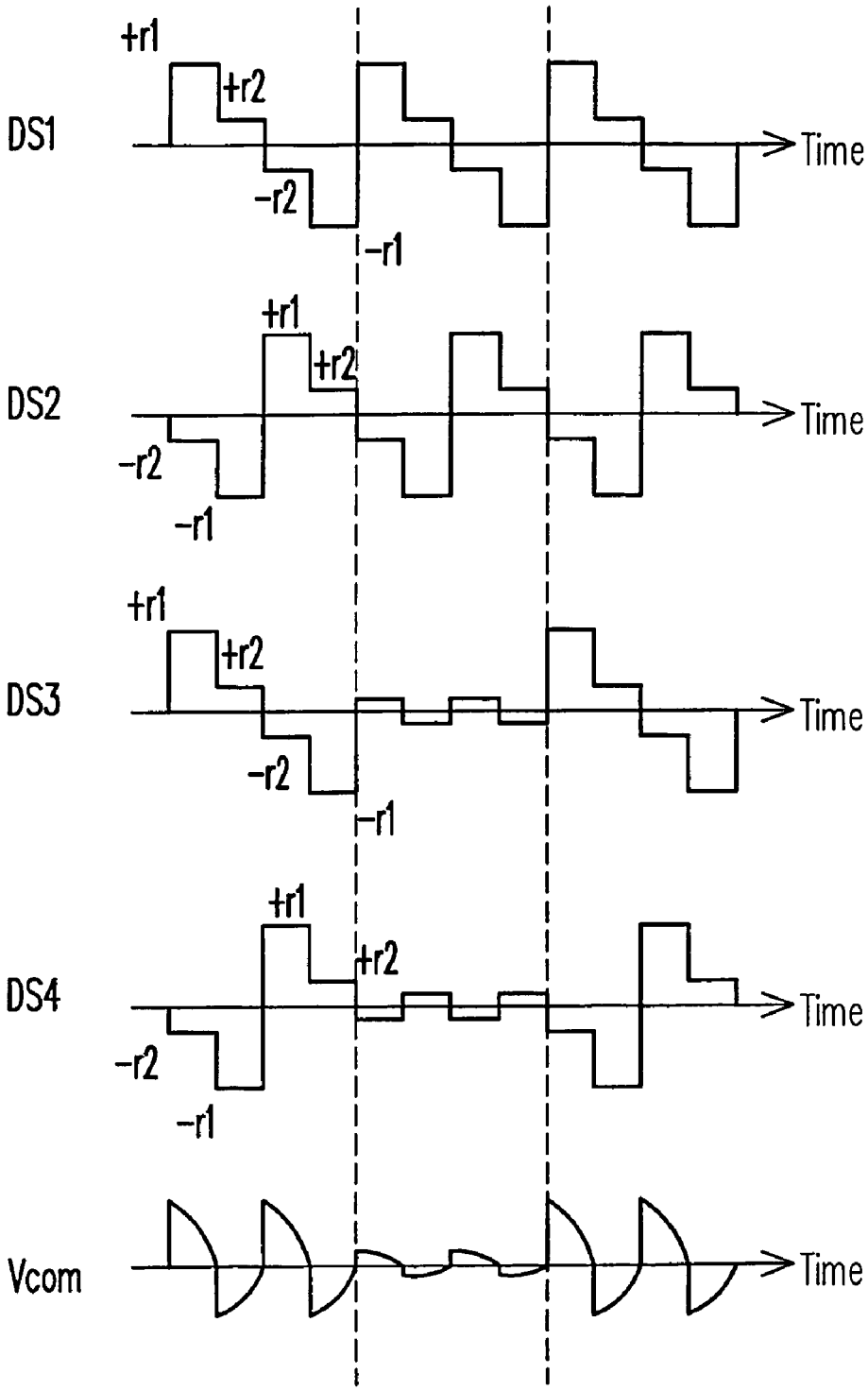
FIG. 2A (PRIOR ART)
FIG. 2A illustrates an oscillogram between data signals and a common voltage of a conventional LCD panel.
Figures 2B, 2C:
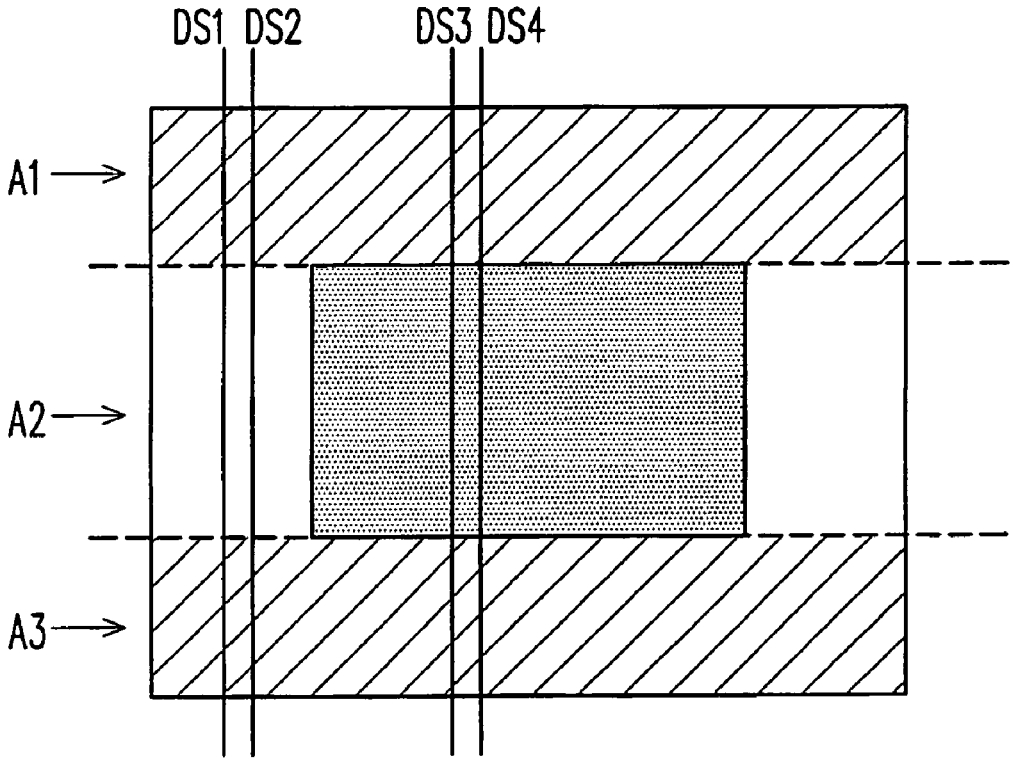
FIG. 2B (PRIOR ART)
FIG. 2C (PRIOR ART)
FIG. 2B is a schematic view illustrating a driving technique of a conventional LCD panel.
FIG. 2C is a schematic view illustrating the cross talk effect on a display panel.
Figure 3:
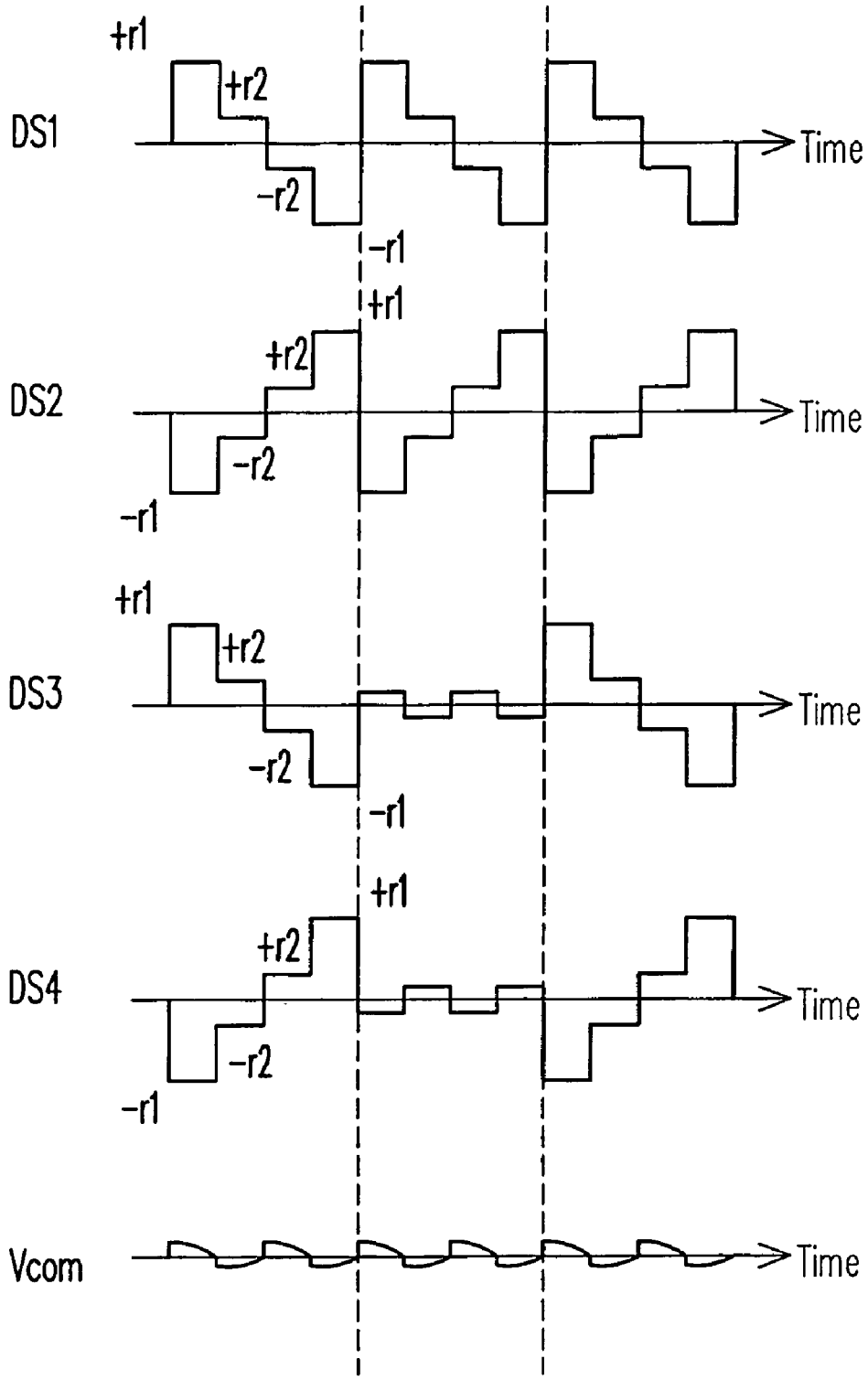
FIG. 3 is a schematic view illustrating a method for driving a display panel according to the first embodiment of the present invention.
Figure 4:
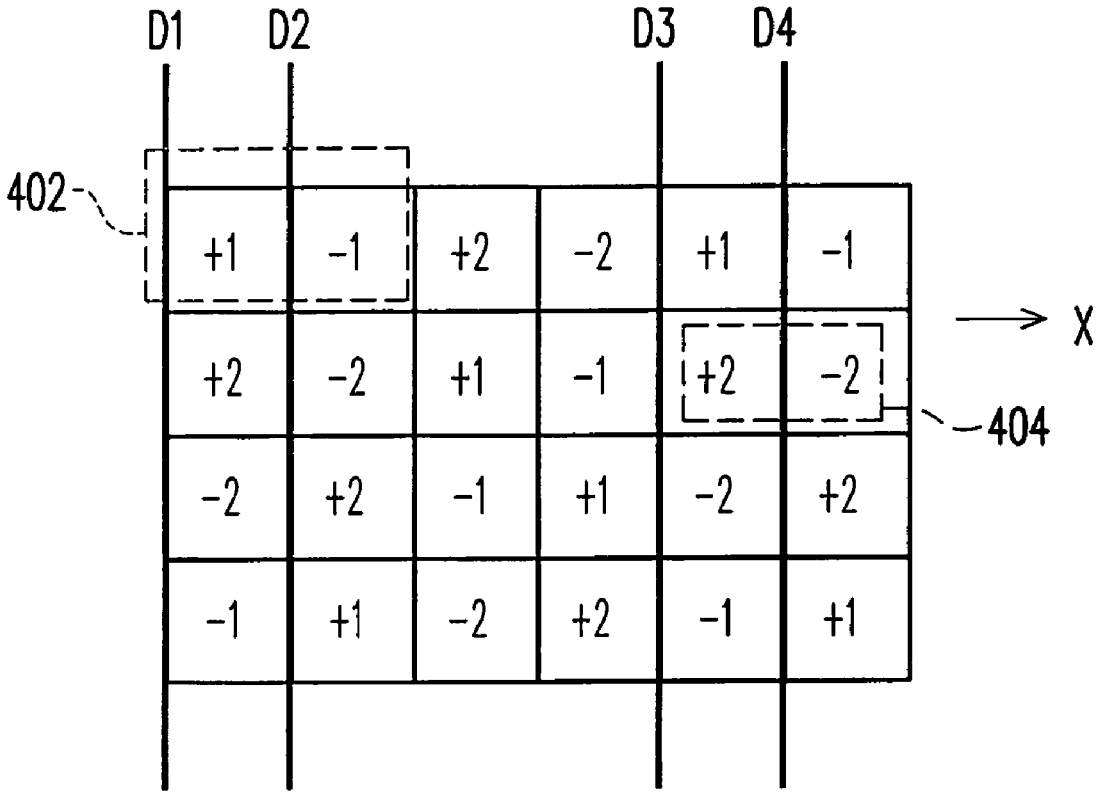
FIG. 4 is a schematic view illustrating voltage values of pixels on a display panel according to the first embodiment of the present invention.

FIG. 3 is a schematic view illustrating a method for driving a display panel according to the first embodiment of the present invention. FIG. 4 is a schematic view illustrating voltage values of pixels on a display panel according to the first embodiment of the present invention. Referring to both FIGS. 3 and 4, the display panel may have a pixel array formed by a plurality of pixels arranged in a matrix. The pixels in the pixel array may be coupled to corresponding data lines respectively, such as D1, D2, D3 and D4. In the present embodiment, a plurality of data signals, such as DS1, DS2, DS3 and DS4, is generated and transmitted to the corresponding data lines respectively. For example, the data signals DS1 and DS2 are transmitted to the two adjacent data lines D1 and D2 respectively. Similarly, the data signals DS3 and DS4 are also transmitted to the two adjacent data lines D3 and D4 respectively.

Among the data signals of the present embodiment, r1 level represents a bright state voltage and r2 level represents a dark state voltage. Hence, it is clearly shown in FIG. 3 that two adjacent data signals have the same voltage levels but opposite polarities. Thus, in unit areas 402 and 404, a sum of data signal voltage values received by each of the pixels is nearly zero. In other words, adjacent pixels in a direction X may offset their respective capacitance coupling effects with each other so that a voltage value of a common voltage Vcom in each area of the display panel is substantially the same. Accordingly, influence of the cross talk effect is effectively reduced.

The Second Embodiment

Figure 5:
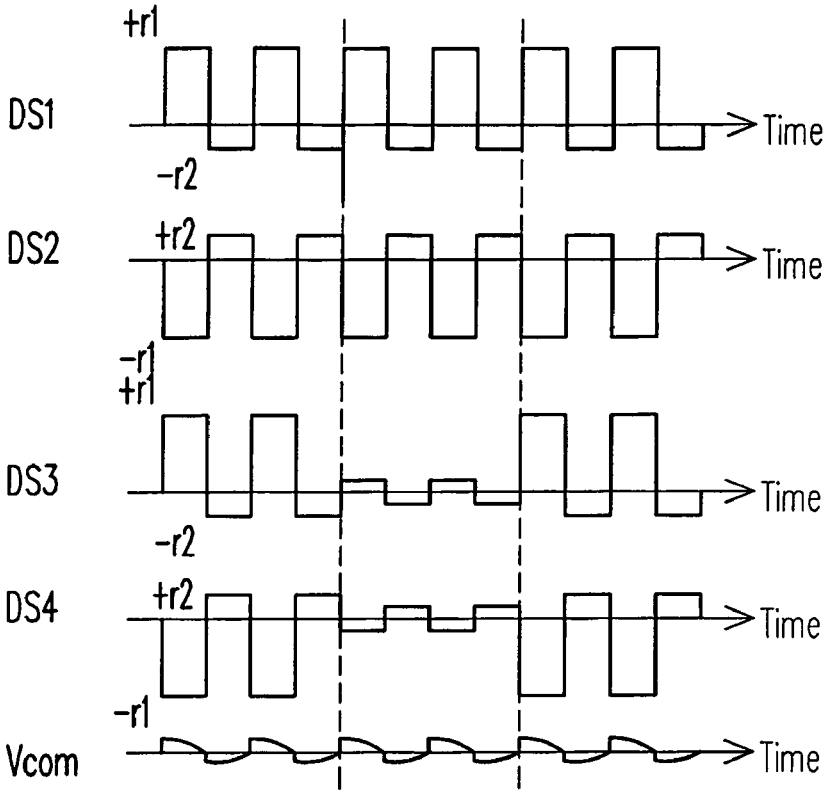
FIG. 5 is a schematic view illustrating a method for driving a display panel according to the second embodiment of the present invention.
Figure 6:
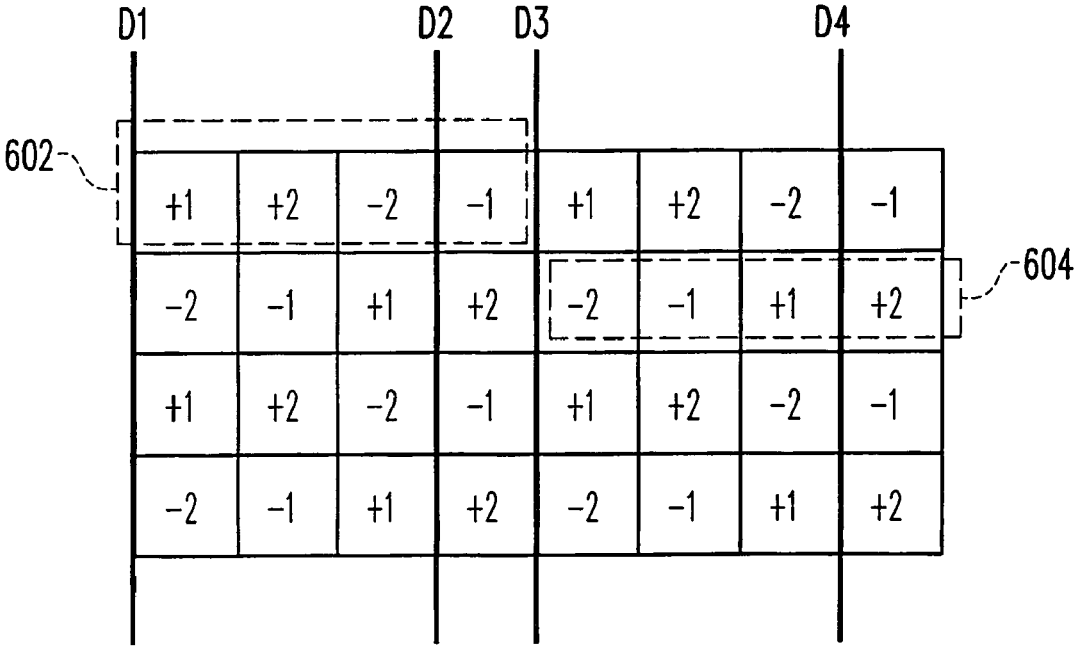
FIG. 6 illustrates a schematic view illustrating voltage values of pixels on a display panel according to the second embodiment of the present invention.

FIG. 5 is a schematic view illustrating a method for driving a display panel according to the second embodiment of the present invention. FIG. 6 is a schematic view illustrating voltage values of pixels on a display panel according to the second embodiment of the present invention. Referring to both FIGS. 5 and 6, in the present embodiment, waveforms of a plurality of data signals, such as DS1, DS2, DS3 and DS4, may also be provided likewise. A difference between the first and second embodiments lies in that two data signals having the same voltage levels but opposite polarities are not necessarily transmitted to two adjacent data lines in the pixel array. For example, the data signals DS1 and DS2 may be transmitted to the data lines D1 and D2 respectively and the data signals DS3 and DS4 may be transmitted to the data lines D3 and D4 respectively. The data lines D1 and D2 are not adjacent to each other. Likewise, the data lines D3 and D4 are not adjacent data lines, either.

Although two data signals having the same voltage levels but opposite polarities may be transmitted to two non-adjacent data lines, it is still required that a sum of the voltage values of the data signals in a unit area be rendered substantially zero. For example, in unit areas 602 and 604, a sum of the voltage values of the data signals received by each of the pixels is nearly zero. Thus, the common voltage Vcom in each of the areas of the display panel is nearly the same so as to reduce the influence of the cross talk effect on the display panel.

The Third Embodiment

Figure 7:
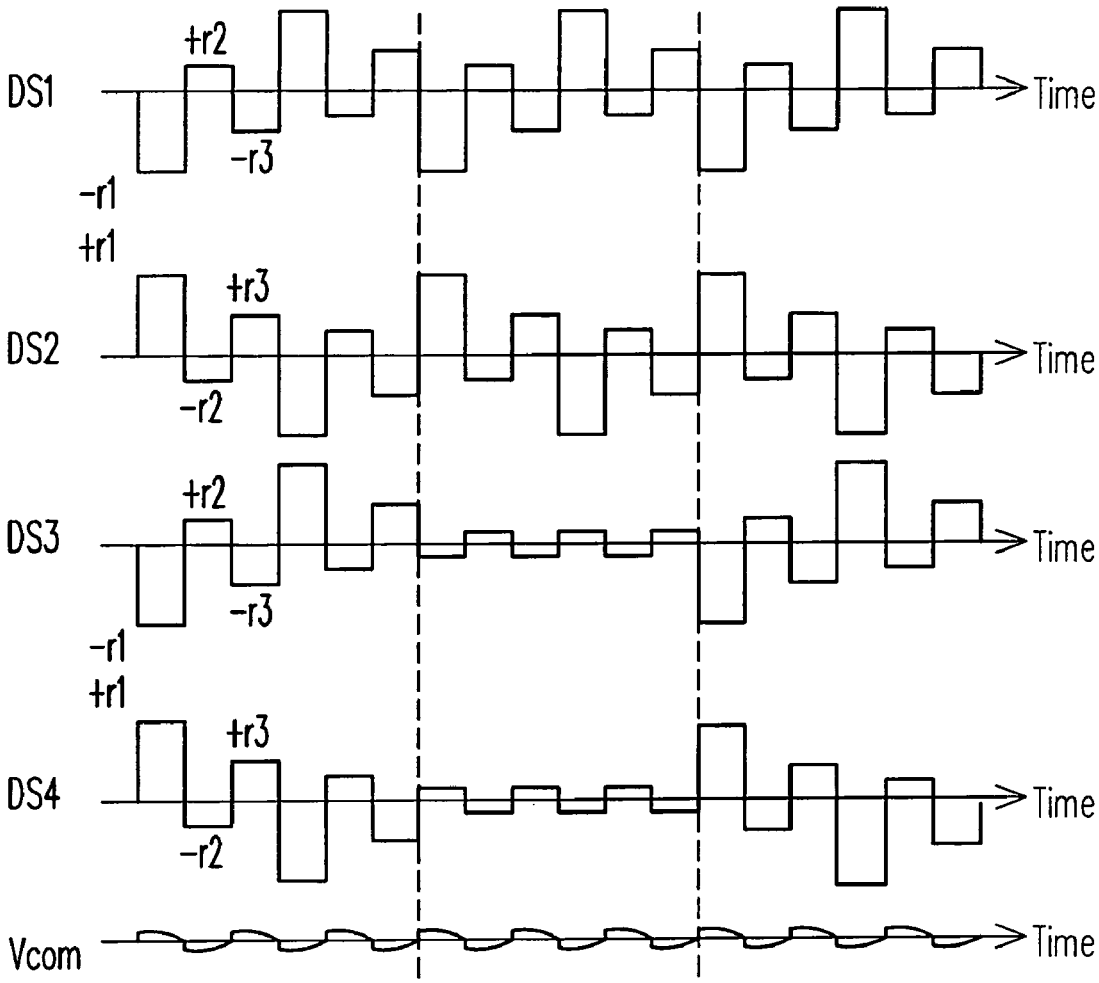
FIG. 7 is a schematic view illustrating a method for driving a display panel according to the third embodiment of the present invention.
Figure 8:
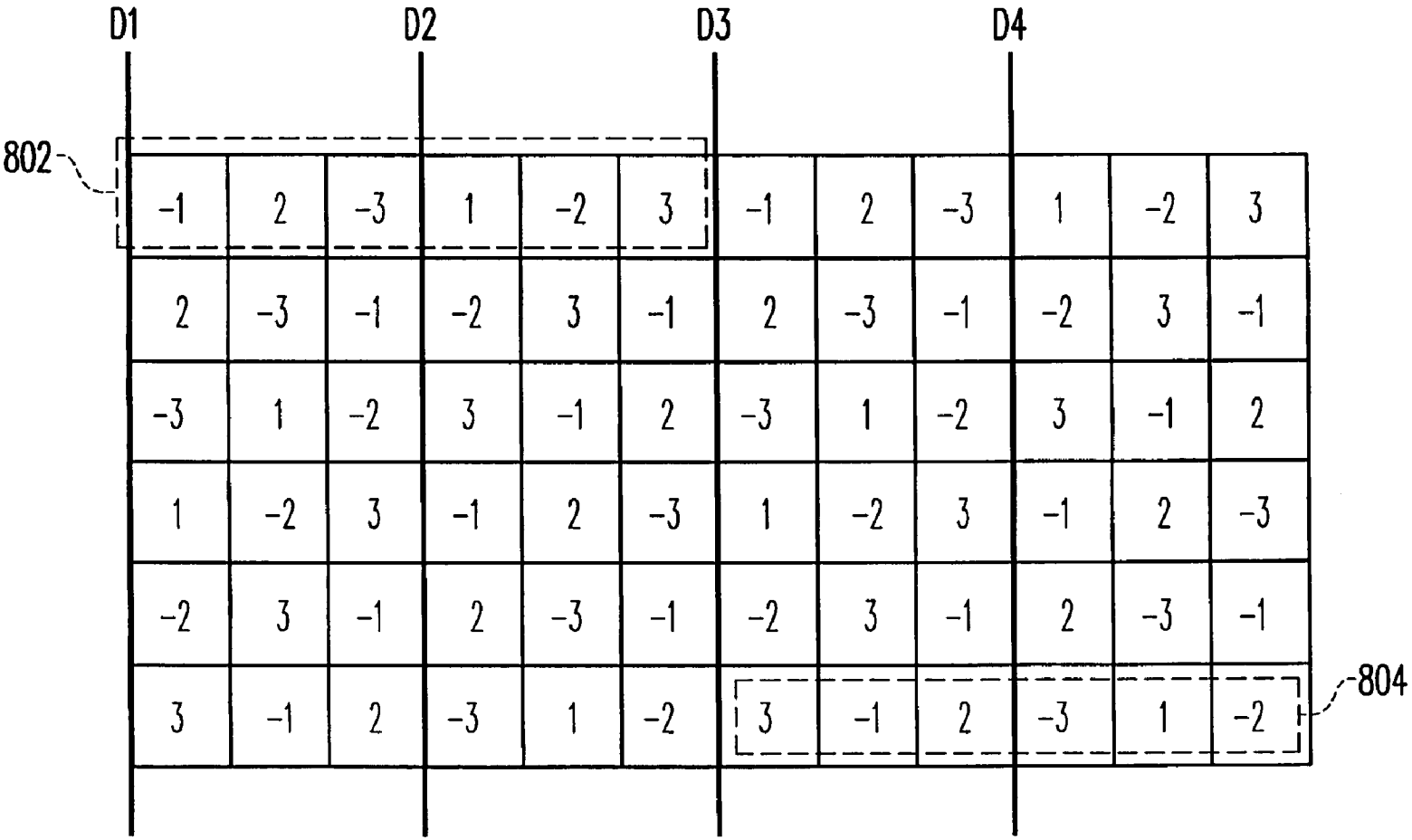
FIG. 8 is a schematic view illustrating voltage values of pixels on a display panel according to the third embodiment of the present invention.

FIG. 7 is a schematic view illustrating a method for driving a display panel according to the third embodiment of the present invention. FIG. 8 is a schematic view illustrating voltage values of pixels on a display panel according to the third embodiment of the present invention. Referring to FIGS. 7 and 8, the present embodiment is similar to the second embodiment in that two data signals have the same voltage levels but opposite polarities are transmitted to two non-adjacent data lines in the pixel array in both embodiments. For example, the data signals DS1 and DS2 are transmitted to the data lines D1 and D2 respectively, and the data signals DS3 and DS4 are transmitted to the data lines D3 and D4 respectively.

Particularly, in the present embodiment, the data signals have not only levels r1 and r2 but also a level r3. Therefore, the driving method of the present invention more accurately controls grayscales and luminance on the display panel in the present embodiment. Similarly, in the unit areas such as 602 and 604 of the present embodiment, a sum of voltage values of data signals received by each of the pixels is substantially zero. Accordingly, the common voltage Vcom in each area of the display panel is rendered nearly the same so as to reduce the influence of the cross talk effect on the display panel.

The Fourth Embodiment

Figure 9:
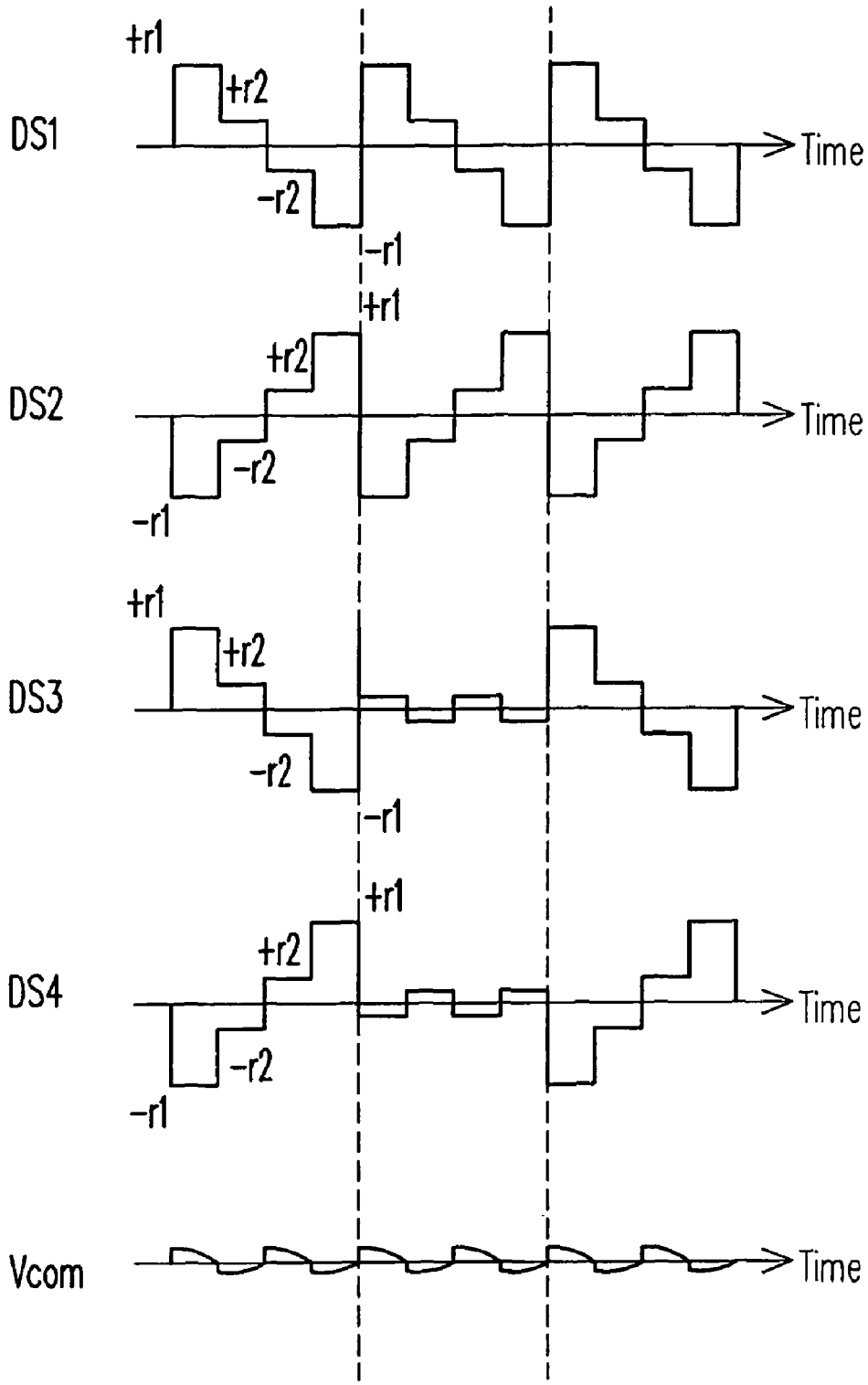
FIG. 9 is a schematic view illustrating a method for driving a display panel according to the fourth embodiment of the present invention.
Figure 10:
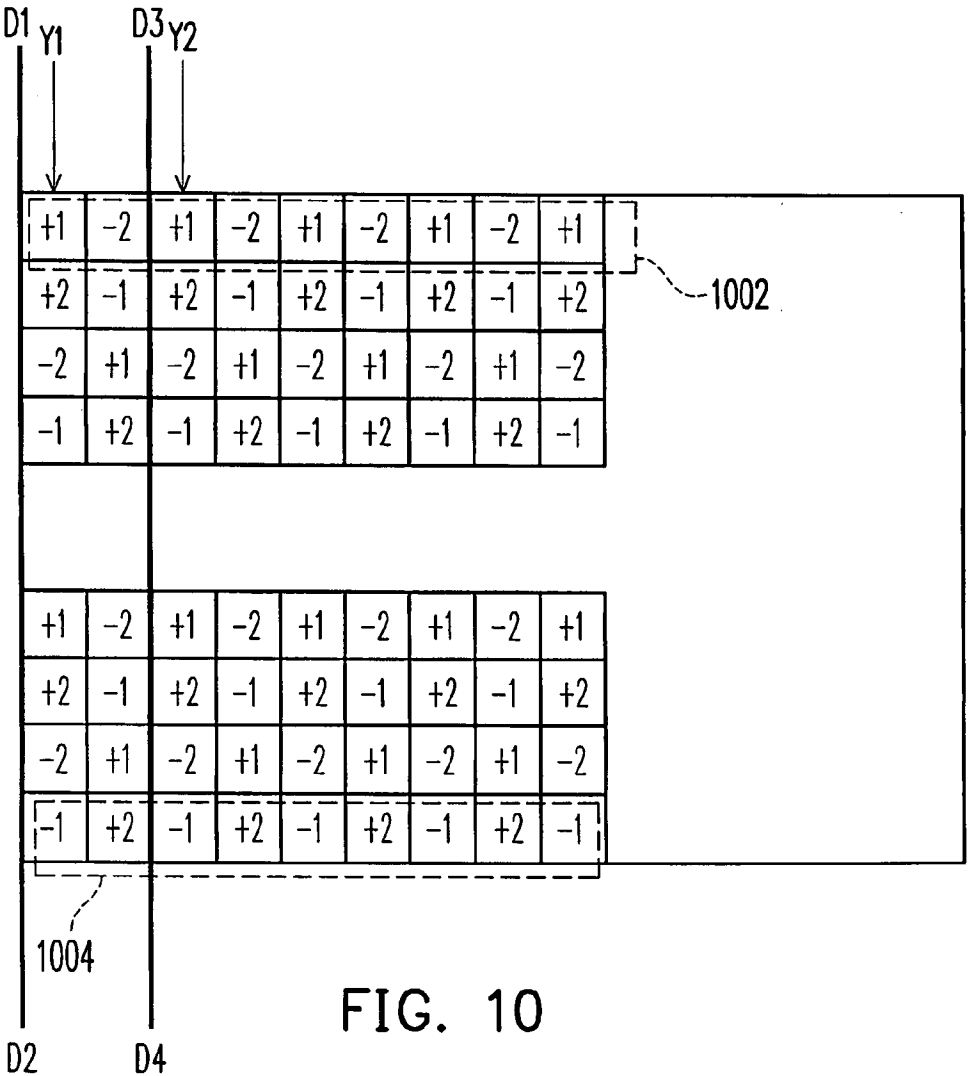
FIG. 10 is a schematic view illustrating voltage values of pixels on a display panel according to the fourth embodiment of the present invention.

FIG. 9 is a schematic view illustrating a method for driving a display panel according to the fourth embodiment of the present invention. FIG. 10 is a schematic view illustrating voltage values of pixels on a display panel according to the fourth embodiment of the present invention. Referring to FIGS. 9 and 10, in the present embodiment, each column of the pixel array is coupled to a plurality of data lines respectively. Pixels on a column Y1 are coupled to the data lines D1 and D2 respectively, and pixels on a column Y2 are coupled to the data lines D3 and D4 respectively. In the present embodiment, the data lines D1 and D2 and the data lines D3 and D4 may be the same data line or different data lines.

Likewise, a plurality of data signals is also provided in the present embodiment, such as DS1, DS2, DS3 and DS4. In the present embodiment, the pixels on each of the columns in the pixel array may be driven by a plurality of data signals respectively. For example, the data signals DS1 and DS2 are inputted to the data lines D1 and D2 respectively so as to drive the pixels on the column Y1 from the first and last pixels thereof. It is clearly shown in FIG. 10 that a voltage level of a data signal received by a $M^{th}$ pixel on each of the columns and a voltage level of a data signal received by a $(M+k)^{th}$ pixel on each of the columns are the same but in opposite polarities. M and k may both be positive integers. Thus, a sum of the voltage values received by each of the pixels in each of the unit areas, such as unit areas 1002 and 1004, is substantially zero.

The Fifth Embodiment

FIG. 11 is a schematic view illustrating voltage values of pixels on a display panel in different frames according to the fifth embodiment of the present invention. Referring to FIG. 11, in the present embodiment, not only spatially is a sum of voltage values of data signals received by each of the pixels in each of the unit areas rendered zero, but within a unit time, a sum of voltage values of data signals received by each of the pixels in a corresponding position is also rendered zero. Specifically, in the present embodiment of the present invention, a plurality of frames may be generated within a unit time, such as F1, F2, F3, F4, F5 and F6. Furthermore, voltage levels and polarities of data signals received by the pixel array in each of the frames are adjusted so that the sum of the voltage values of the data signals received by the pixels in corresponding positions in these frames is zero. For example, a sum of voltage values of data signals received by a pixel 1102 within one unit time is substantially zero.

To further solve the problem of color washout, in the present embodiment of the present invention, a number of repeated times of a voltage value of a data signal representing dark state received by each of the pixels within a unit time may be larger than a number of repeated times of a voltage value of a data signal representing bright state. Taking the pixel 1102 for example, a voltage value "−1" or "+1" of a data signal representing dark state received by the pixel 1102 is repeated four times, i.e. frames F1, F2, F4 and F5 respectively. Oppositely, a voltage value "−2" or "+2" of a data signal representing bright state received by the pixel 1102 is repeated two times, i.e. frames F3 and F6 respectively. Therefore, influence of the cross talk effect is effectively reduced so as to further solve the problem of color washout in the frames.

Figure 12:
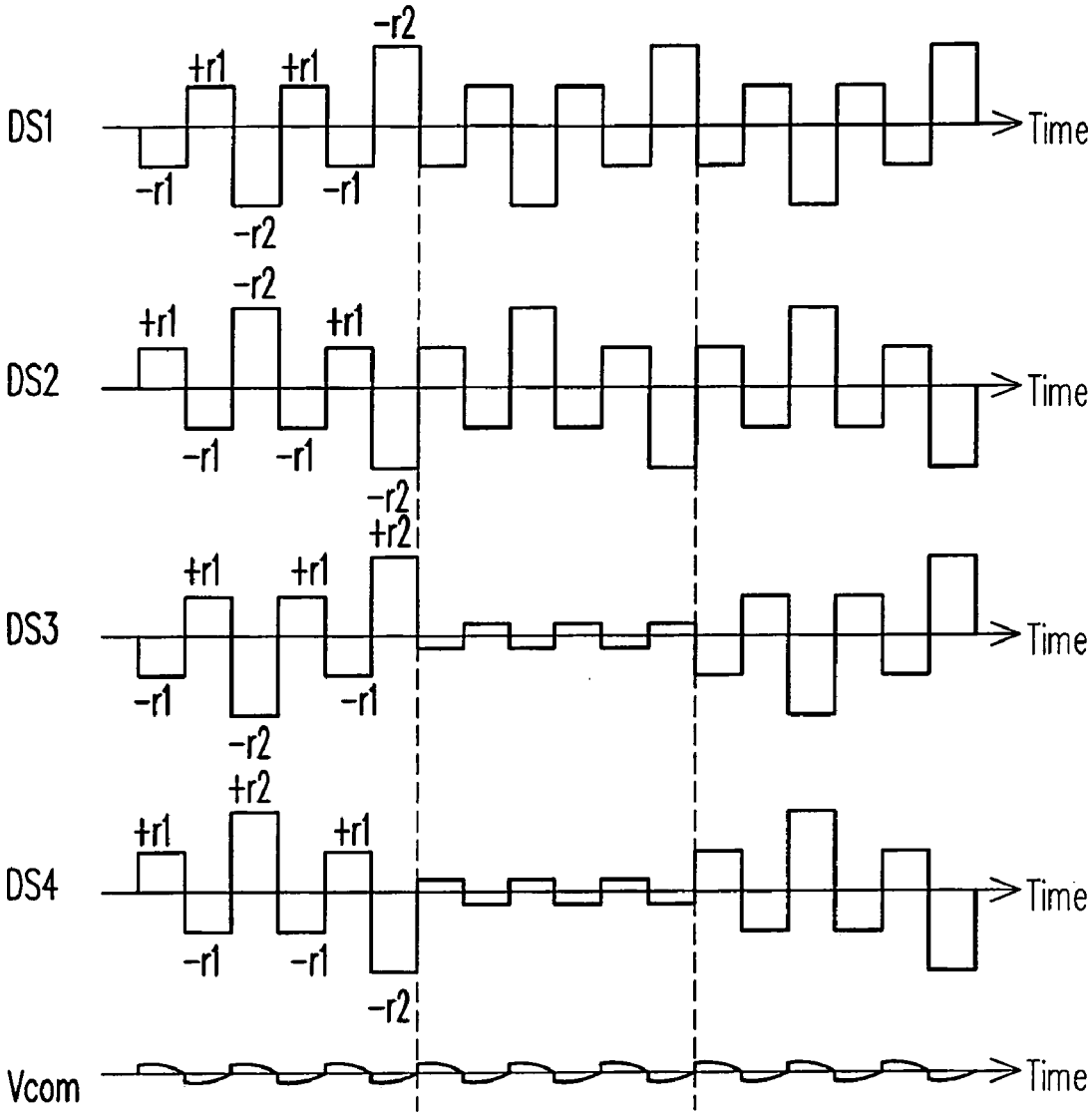
FIG. 12 is a schematic view illustrating a method for driving a display panel according to the fifth embodiment of the present invention.
Figure 13:
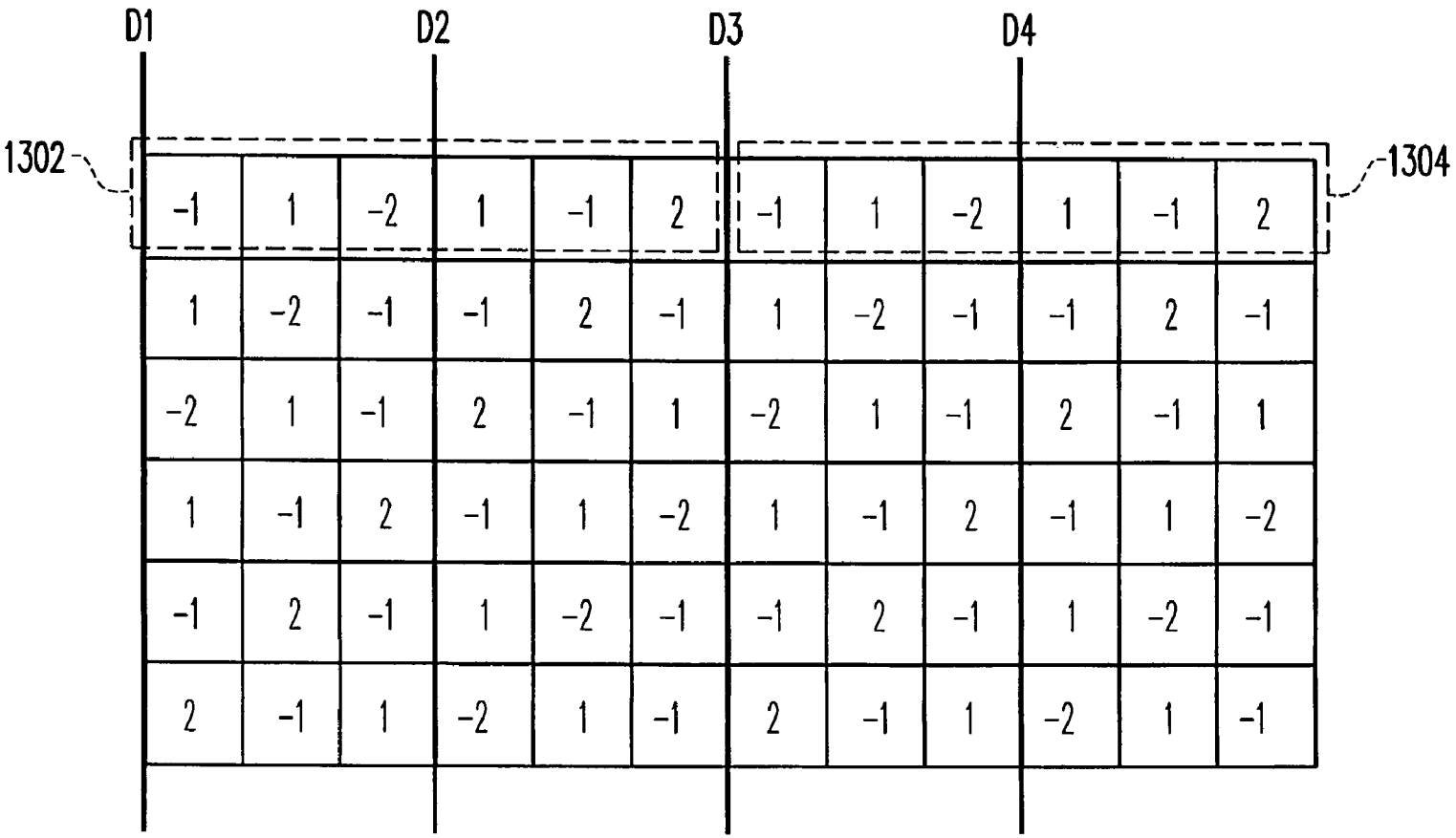
FIG. 13 is a schematic view illustrating voltage values of pixels on a display panel in the same frame according to the fifth embodiment of the present invention.

FIG. 12 is a schematic view illustrating a method for driving a display panel according to the fifth embodiment of the present invention. FIG. 13 is a schematic view illustrating voltage values of pixels on the display panel in the same frame according to the fifth embodiment of the present invention. Referring to FIGS. 12 and 13, in the present embodiment, a plurality of data signals is also provided likewise, such as DS1, DS2, DS3 and DS4. The data signals DS1 and DS2 may be transmitted to the data lines D1 and D2 respectively and the data signals DS3 and DS4 may be transmitted to the data lines D3 and D4 respectively. As the foregoing embodiment, in each of the same frames of the present embodiment, a sum of voltage values of data signals received by each of the pixels in a unit area is substantially zero. For example, in unit areas 1302 and 1304, a sum of voltage values of data signals received by each of the pixels is nearly zero. Thus, the common voltage Vcom in any area of the display panel has substantially the same voltage value and thereby reducing the influence of the cross talk effect.

Moreover, besides arranging more dark state voltages in different times in the present embodiment, in some optional embodiments of the present invention, more dark state voltages may be further arranged in frames within one single time. For example, in FIG. 12, a number of pixels receiving dark state voltages is significantly larger than a number of pixels receiving bright state voltages. Thus, the method of the present invention also effectively solves the problem of color washout.

Although a plurality of embodiments has been provided to illustrate the spirit of the present invention, the present invention is not limited to these examples. People having ordinary skill in the art should know that the primary spirit of the present invention lies in adjusting the cross voltage of the liquid crystal capacitor in each of the pixels within a unit area so that the cross voltages of one pixel and another pixel in a corresponding position have the same level but opposite polarities. Therefore, as long as a solution includes adjusting the cross voltage of the liquid crystal capacitor in the pixel so that the sum of voltage values of the data signals received by each pixel in the unit area is zero, the solution falls within the scope over which the present invention seeks protection.

In summary, since the sum of voltage values of the data signals received by each pixel in a unit area is rendered zero in the present invention, the influence of the cross talk effect is effectively reduced in the present invention. Additionally, since simply the cross voltage of the liquid crystal capacitor in each pixel is adjusted in the present invention, only the driving mode of the firmware rather than the hardware structure requires alteration. Therefore, the present invention does not consume too much cost and does not include more complicated means, either.

Although the present invention has been disclosed above by preferred embodiments, they are not intended to limit the present invention. Anybody skilled in the art can make some modifications and alterations without departing from the spirit and scope of the present invention. Therefore, the protecting range of the present invention falls in the appended claims.

What is claimed is:

1. A method for driving a display panel, comprising:

generating a plurality of data signals to drive a plurality of pixels in the display panel, wherein the pixels are arranged in a matrix;

adjusting voltage polarities and voltage levels of the data signals so that a sum of voltage values of the data signals in a unit area of the display panel is substantially zero;

generating a plurality of frames within a unit time according to the data signals, wherein a number of the frames within the unit time is an even number greater than 4; and adjusting voltage levels and voltage polarities of the data signals so that a sum of voltage values of pixels in the same position in the frames within the unit time is substantially zero, wherein for each of the pixels in the same position in the frames within the unit time, a number of repeated times of a voltage value of a received data signal representing dark state is larger than a number of repeated times of a voltage value of a received data signal representing bright state, wherein for each of the pixels in the same position in the frames within the unit time, the number of repeated times of the voltage value of the received data signal representing dark state is a first predetermined positive integer, wherein for each of the pixels in the same position in the frames within the unit time, the number of repeated times of the voltage value of the received data signal representing bright state is a second predetermined positive integer, wherein the first predetermined positive integer is greater than the second predetermined positive integer.

2. A method for driving a display panel suitable for a display panel having a plurality of pixels arranged into a pixel array, the method comprising:

adjusting a cross voltage level of a liquid crystal capacitor of each of the pixels in a unit area of the pixel array to be the same as a cross voltage level of a liquid crystal capacitor of another pixel in a corresponding position in the unit area;

adjusting a cross voltage polarity of the liquid crystal capacitor of each of the pixels in the unit area to be opposite to a cross voltage polarity of the liquid crystal capacitor of another pixel in a corresponding position in the unit area; and generating a plurality of frames on the display panel within a unit time, and adjusting each of the pixels in each of the frames and another pixel in the same position in a corresponding frame within the unit time to have the same liquid crystal cross voltage level but opposite polarities, wherein a number of the frames within the unit time is an even number greater than 4, and wherein for each of the pixels in the same position in the frames within the unit time, a number of repeated times of a received liquid crystal cross voltage representing dark state is larger than a number of repeated times of a received liquid crystal cross voltage representing bright state, wherein for each of the pixels in the same position in the frames within the unit time, the number of repeated times of the received liquid crystal cross voltage representing dark state is a first predetermined positive integer, wherein for each of the pixels in the same position in the frames within the unit time, the number of repeated times of the received liquid crystal cross voltage representing bright state is a second predetermined positive integer, wherein the first predetermined positive integer is greater than the second predetermined positive integer.

* * * * *